US006524386B1

(12) United States Patent
Slager, Sr.

(10) Patent No.: US 6,524,386 B1
(45) Date of Patent: Feb. 25, 2003

(54) SURFACE TREATING APPARATUS

(76) Inventor: David P. Slager, Sr., 747 W. Old Monee Rd., Crete, IL (US) 60417

( * ) Notice: Subject to any disclaimer, the term of this patent is extended or adjusted under 35 U.S.C. 154(b) by 0 days.

(21) Appl. No.: 10/081,032

(22) Filed: Feb. 20, 2002

(51) Int. Cl.[7] ..... B05C 5/02

(52) U.S. Cl. ..... 118/207; 118/264; 118/266; 118/305; 15/98

(58) Field of Search ..... 118/207, 264, 118/266, 305; 427/429; 15/50.1, 98, 320–322; 401/48

(56) References Cited

U.S. PATENT DOCUMENTS 1,602,314 A 10/1926 Signor ..... 118/407
4,471,713 A 9/1984 Cote et al. ..... 118/108
4,766,016 A 8/1988 Kubo ..... 427/428
4,809,397 A 3/1989 Jacobs et al. ..... 15/320
4,893,375 A 1/1990 Girman et al. ..... 15/321
5,050,530 A * 9/1991 Studebaker et al. ..... 118/264
5,109,791 A 5/1992 Matsumoto et al. ..... 118/63

* cited by examiner

*Primary Examiner*—Laura Edwards
(74) *Attorney, Agent, or Firm*—Evan D. Roberts

(57) ABSTRACT

A surface treating apparatus having: a frame supported on wheels; fluid treatment applicator pivotally mounted to the frame; fluid treatment supply; a pump actuatable for moving the fluid supply to the surface; trigger mechanism responsive to rotation of a support wheel to actuate the pump; and a timer to limit the term of the pump actuation.

18 Claims, 4 Drawing Sheets

SURFACE TREATING APPARATUS

BACKGROUND OF THE INVENTION

This invention is an apparatus for providing uniform controlled application and spreading of surface treating fluid on surfaces such as floors, as the apparatus is moved freely over the floor.

It is typical of past approaches, in providing the application of treating fluid to floors, to provide a carriage with two large wheels on an axle and two casters to support the carriage. However, it is also typical to impose a mechanical pumping mechanism on the axle to pump treating fluid onto the floor whenever the wheel and axle are rotated as the carriage is pushed or manipulated over the surface of the floor. This creates a significant resistance to straight and turning movement of the carriage and tends to cause untimely dispensing of treating fluid when the carriage is turned or otherwise manipulated, and otherwise, when no treating fluid is called for.

Also, having a fluid pumping mechanism imposed on the support wheel or axle causes resistance to motion of the carriage. This resistance impedes the required movement and regular turning manipulation of the carriage, reducing efficiency, and causing fatigue of the operator.

Further, inasmuch as prior contrivances tend to have the mechanically driven fluid pump as a slave to the rotation of the wheels and axle, it is difficult to make any adjustments to the quantity of fluid flow relative to movement of the carriage over the floor and rotation of the support wheels. Often this requires complicated plumbing and mechanical pumping apparatus. Also, this requires that the wheels must rotate to actuate the pump to supply fluid to the floor, when there are occasions that it would be desirable to provide fluid without having to move the carriage for some distance over the floor to activate the pump.

Inversely, there are occasions, in the situation, where the pump is a slave to rotation of the carriage wheels, that treating fluid would be pumped when no fluid is desired. A specific example would be when the fluid applicator is pivoted up and away from the floor. This requires a pan or trough be provided to intercede and catch the treating fluid to prevent unwanted application of treating fluid to the floor. In addition, past contrivances that have a mechanically driven pump as a slave to the rotation of the axle, the pump will tend to provide a pulsing supply action as the axle cycles the supply pump. This pulsing tendency lessens the likelihood of providing a uniform application of treating fluid.

Also, when a mechanically driven treating pump is a slave to the wheel and axle rotation, as in prior art, the speed with which the operator is required to move the carriage over the surface of the floor is also a slave to the pumping mechanism. This does not allow ready differentiation between over-the-floor speed of the carriage and pumping speed for supplying fluid as may be desired when the carriage is in motion.

Various prior art carriages provide an applicator pad support structure or other spreader for the treating fluid by placing a pad or other spreader in the path of the carriage. Typically, the pad is placed flat or loosely on the floor to be treated and the pad tends to float on fluid on the floor, or deflect as a result of varying friction with the floor, without providing a uniform applying and spreading action of fluid on the floor, such as a squeegee action to control the quality of the application.

SUMMARY OF THE INVENTION

It is the general object of this invention to create an apparatus for providing uniform controlled application and spreading of surface treating fluid on floor surfaces as the apparatus is freely moved over, and otherwise manipulated over the floor surface.

More particularly, it is an object of this invention to provide a surface treating apparatus whereby treating fluid is pumped onto the floor, to be treated, without imposing any mechanical pumping mechanism on the supporting wheels of the apparatus.

Also, it is an object of this invention to provide a surface treating apparatus having a treating fluid pumping system that is independent, of and not a mechanical slave of over-the-floor straight line movement, or turning manipulation, of the apparatus.

In addition, it is a further object of this invention to provide a surface treating apparatus having a treating fluid pumping system which is significantly independent of movement and manipulation of the carriage of the apparatus over the floor. This allows the operator to provide a controlled, and uniform, yet differentiating, quantum of treating fluid without requiring, or enslaving, the operator to be confined to a fluid supply dictated by the rotation of the wheels or the manipulation of the apparatus in turns and change in directions.

Moreover, it is a further object of this invention to provide a system which provides a retractable, yet squeegee like, application to facilitate a controlled uniform and efficient spreading of treating fluid.

Other advantages, objects and novel aspects of the invention will become apparent upon the following detailed description, in conjunction with the accompanying drawings wherein.

Figure 3:
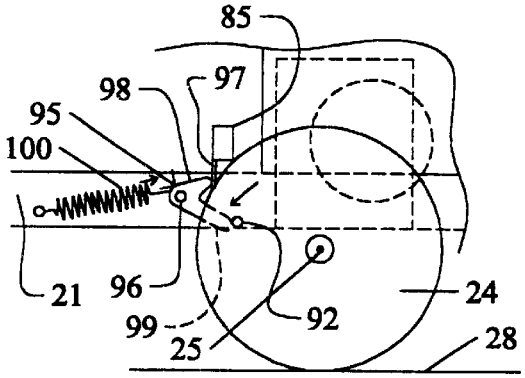
FIG. 3 is a partial side view of the apparatus of the invention showing actuation of the pump switch as the apparatus is moved rearwardly over the floor.
Figure 4:
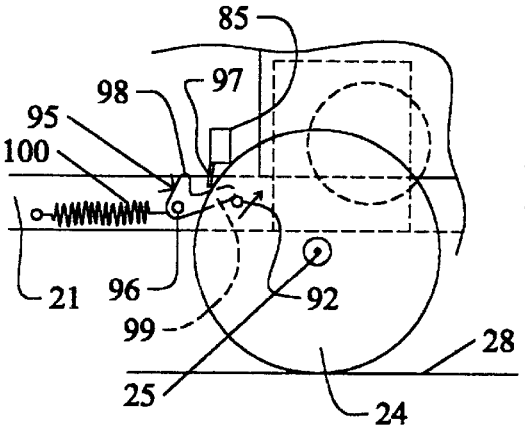
FIG. 4 is a partial side view of the apparatus of the invention showing non-activation of the pump switch as the apparatus is moved rearwardly over the floor.
Figure 1:
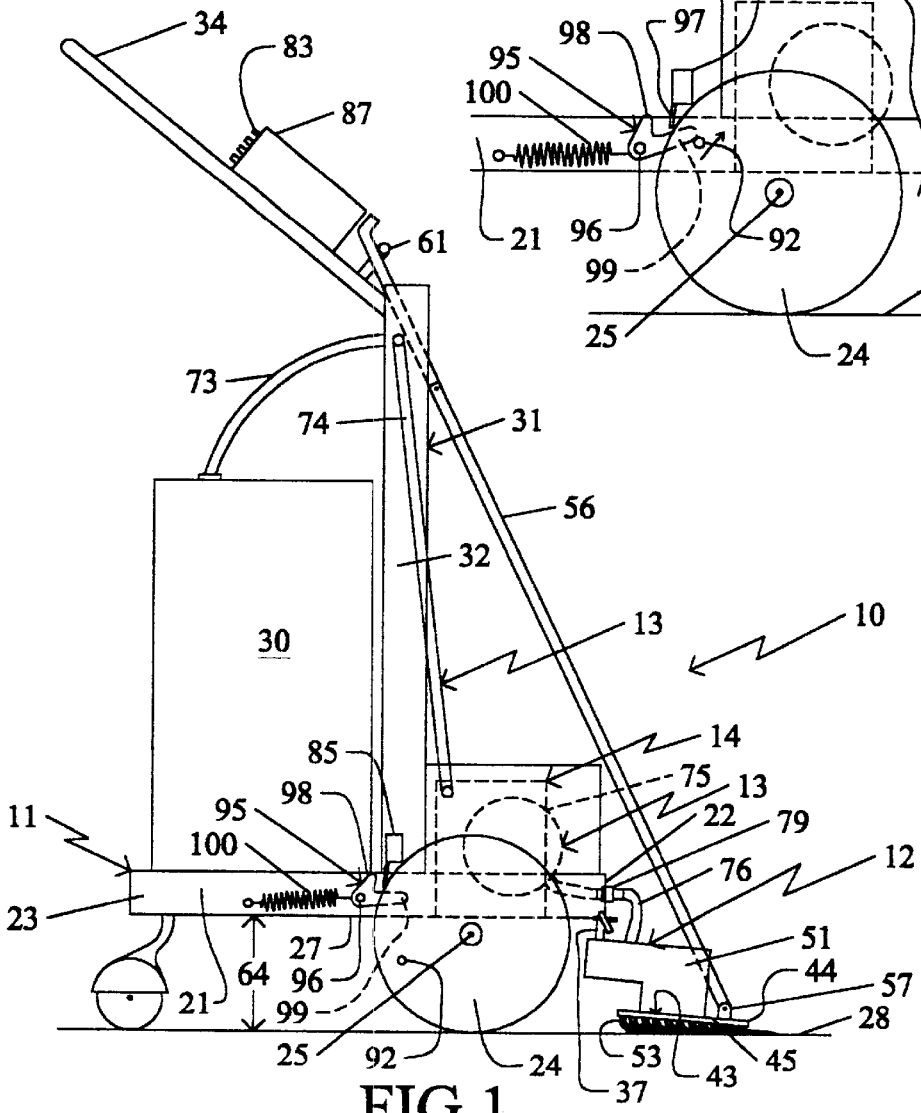
FIG. 1 is a right side view of the apparatus of the invention showing the fluid treatment applicator, of the apparatus, applying treating fluid to a floor surface.

An illustrative example of the surface treating apparatus of this invention is generally designated by the numeral 10 (FIGS. 1, 2 and 8) and generally includes a carriage frame 11, surface treating applicator assembly 12, fluid treating pump system 13, special power source 14.

Carriage frame 11 (FIGS. 1–4) has left and right sides 21, and front 22 and rear portions 23 forming a rigid structure 11. Frame 11 (FIGS. 1, 2 and 8) is supported on freely rotating front wheels 24, on axel 25 mounted to frame 11, and on caster wheels, at rear portion 23 of frame 11. Treating fluid 29 (FIG. 6) is stored in treatment supply tank 30 which is secured on frame 11 having a bottom surface 27. Wheels 24 and casters support apparatus 10 on floor surface 28 to be treated. Manipulating column 31 (FIGS. 1, 2 and 8) is secured to frame 11 and has two vertical column legs 32 (FIG. 2) and a horizontal lateral connection 33. Operator handlebar 34 is secured to columns 13 of frame 11. By moving handlebar 34 in a horizontal arc, apparatus 10 can be readily rotated horizontally about itself, or through any lesser arc or straight movement as any operator may desire, for unlimited manipulation control of apparatus 10.

Figure 2:
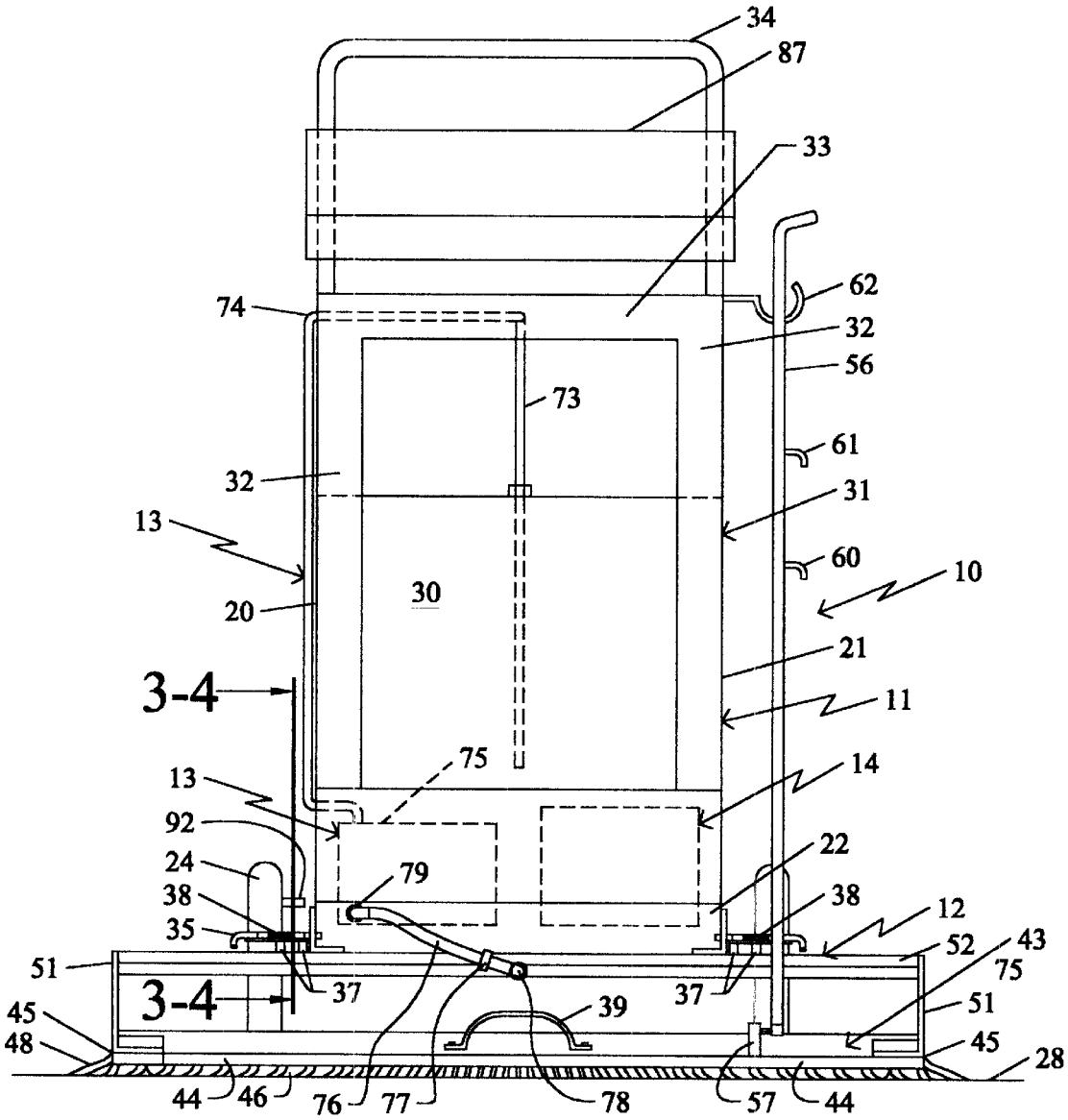
FIG. 2 is a front view of the apparatus of the invention showing the fluid treatment applicator, of the apparatus, applying treating fluid to a floor surface.
Figure 5:
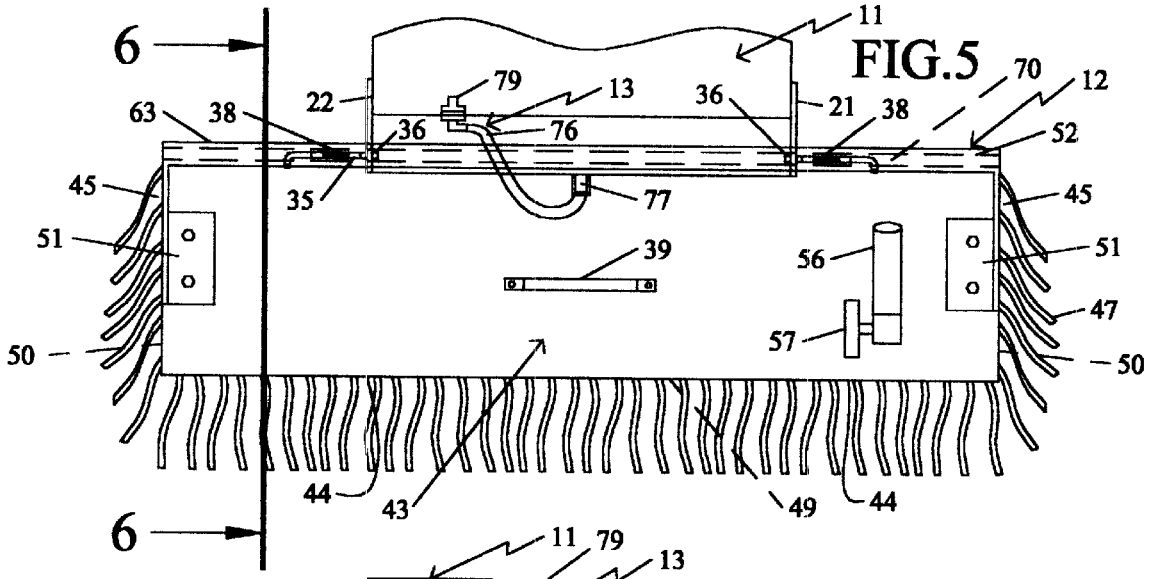
FIG. 5 is a partial top view of the apparatus of the invention showing the applicator attached to the front of the apparatus of the invention.

Surface treating applicator assembly 12 is pivotally mounted to carriage 11 by retractable pins 35 (FIGS. 2 and 5) in openings in carriage front portion 22 adjacent bottom surface 27 of frame 11. Each of pins 35 is slidably mounted on two attachment brackets 37 (FIGS. 1, 2 and 5) on applicator assembly 12 and are movable against springs 38 (FIGS. 2 and 5) to allow pins 35 to be removed from openings 36 in carriage front portion 22 to allow manual detachment removal of applicator assembly 12 from carriage 11 by handle 39 (FIGS. 2, 5 and 6).

Figure 6:
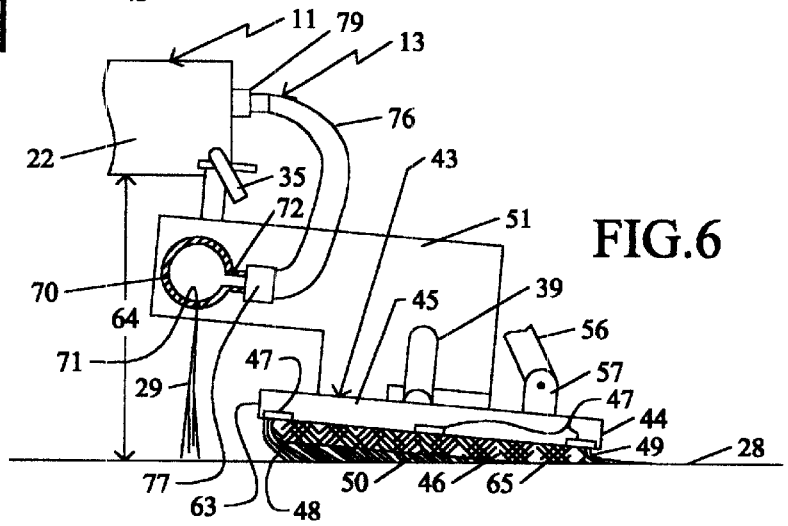
FIG. 6 is a sectional view taken along line 6—6 of FIG. 5 showing the applicator of the invention applied to the floor, to be treated, and showing the treating fluid expelling onto the floor to be treated.

Applicator assembly 12 (FIGS. 5 and 6) has a plate 43 with front edge 44 and opposite side edges 45 and has fluid treatment applicator pad 46 removably attached to plate 43 by interlocking fibers, or the like 47 (FIG. 6). Pad 43 has yarn strands 48 (FIGS. 5 and 6) attached to pad peripheral front edge 49 and pad peripheral sides 50 and extend beyond plate 45 (FIG. 5). L-shaped attachment arms 51 are secured to the left and right side ends 45 of plate 43 and have frame 52 there between to which pin attachment brackets 37 are secured.

Figure 8:
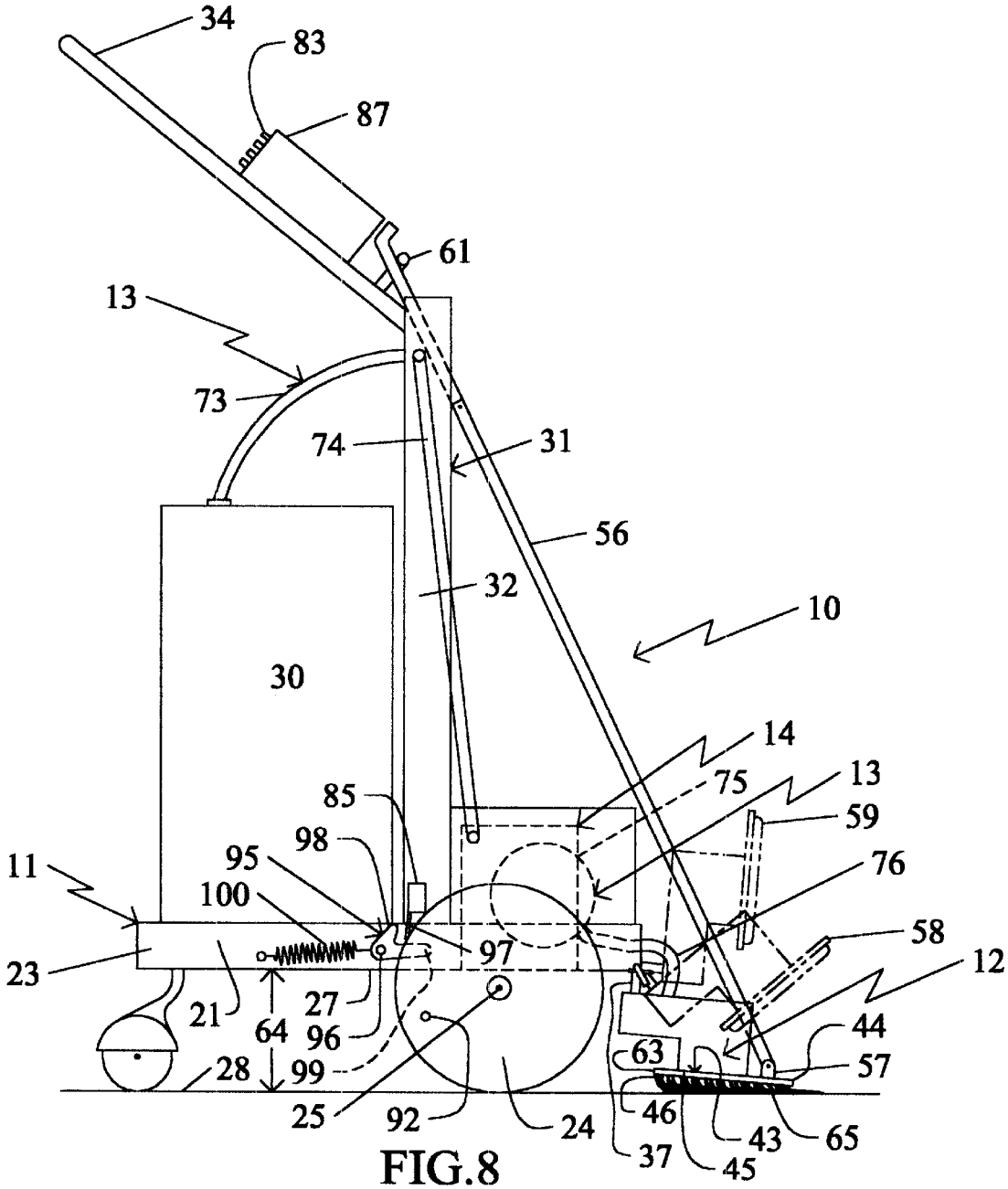
FIG. 8 is a right side view of the apparatus of the invention showing how the fluid treatment applicator of the apparatus, can be withdrawn from the floor application position to other positions.

Applicator assembly 12 has a retracting shaft 56 (FIGS. 1, 2, 5, 6 and 8) pivotally attached to bracket 57 on plate 43 and extends to adjacent handlebar 34. By moving shaft 56 upwardly toward handlebar 34, applicator assembly 12 can be rotated about pins 35 (FIG. 8). Applicator assembly can thereby be locked in selected first and second upward positions 58 and 59 (FIG. 8) by engaging either of shaft hooks 60 or 61 on hook retainer 62 on frame 11.

It should be noted (FIGS. 1, 6 and 8) that bottom surface 27 of carriage frame 11 is specifically spaced a certain distance 64 above floor surface 28 to be treated. Pad 46 of applicator assembly 12 will thereby engage surface 28, at an angle to surface 28, with plate rear portion 63 (FIGS. 6 and 8) of plate 43 and rear portion of pad 46 above surface 28, and front portion 49 of pad 46 in full engagement with surface 28 at 65 to provide a squeegee like action with surface 28 when apparatus 10 is moved rearwardly (leftwardly, FIGS. 1, 3 and 8) over surface 28. Also attachment arms 51 are specifically shaped to allow applicator assembly to be drawn over surface 28 in rearward direction as apparatus is moved rearwardly over floor 28. This precludes applicator assembly 12 from stubbing or flipping up because of friction with floor 28 such as when assembly 12 passes through a dry spot on floor 28 having no treating fluid, making assembly 12 very stable in application.

Pump system 13 includes manifold spray tube 70 (FIGS. 2, 5 and 6) shown in frame 52 of applicator assembly 12 and extends between attachment brackets 37. Manifold spray tube 70 could similarly be mounted in carriage 11 (not shown) to the rear of applicator assembly 12. Spray tube 70 (FIG. 6) has openings 71 spaced along bottom length of tube 70 to facilitate treating fluid 29 being expelled from tube 70 onto surface 28 to be treated. Spray tube 70 has an inlet conduit 72 to accept treating fluid 29 into spray tube 70.

Pump system 13 (FIGS. 1, 6 and 8) also includes fluid treatment 29 supply tank 30, fluid connecting conduits 73 and 74 from tank 30 to pump 75 (FIGS. 1, 2 and 8) and connecting conduit 76 from pump 75 through conduit tube inlet 72 and one-way normally closed pressure responsive release valve 77 and detach connection 78 normally connected to tube 70 of inlet conduit 72. Normally open quick disconnect shutoff coupling 79 is mounted on frame 11 in conduit 76. When pump 75 is activated, by power source 14 (FIG. 7) pump will force treating fluid 29 from tank 30 through conduits 73, 74 and 76 under pressure, and decisively force pressure release valve 77 to release and allow treating fluid 29 to flow through coupling 79 and spray tube 70 (FIG. 6) onto surface 28 to be treated.

Conversely, when pump is deactivated, by disconnecting power source 14, there will be no pump pressure in conduit 76 and release valve 77 will revert to its normally closed condition, instantly and decisively stopping flow of treating fluid 30. Normal decisive closing of valve 77, to terminate treating fluid 29 pressure, prevents overrun of fluid 29. This allows applicator assembly 12 to be withdrawn to positions such as 58 or 59 without dripping overrun fluid 29, and without requiring a pan to catch any overrun fluid. If applicator assembly 43 is to be removed from frame 11, disconnect shutoff coupling 79 can be disconnected and the shutoff portion of coupling 79 in frame 11 will shut off fluid 29 to prevent dispensing of fluid.

Power source 14 (FIG. 7) is illustrated to have, first twelve volt battery 81, second twelve volt battery 82, normally open main switch 83, normally open selector switch 84, normally open trigger switch 85, and manual switch 86. Main switch 83 is positioned in operator control panel 87, for the convenience of the operator (FIGS. 1, 2 and 8), and is shown (FIG. 7) in the off position. In a first alternative, main switch 83 can be moved to twelve volt terminal 88 to place only first battery 81 in power source 14 to supply only twelve volts to selector switch 84. In a second alternative, main switch 83 can be positioned to twenty-four volt terminal 89, putting first and second twelve volt batteries 81 and 82 in series to supply a twenty-four volt potential to selector switch 84. These first and second alternative switch positions 88 and 89 respectively provide a standard and substantially double standard power for pump system 13.

Selector switch 84 (FIGS. 1, 2, 7 and 8) on panel 87 can be moved to manual circuit contact 93 or to an automatic circuit contact 94 to respectively enable manual switch 86 located in panel 87 or to enable trigger switch 85 on frame 11. By selecting either twelve or twenty-four volts by selector switch 83, pump 13 can be operated manually by closing manual switch 86 through return circuit 90 (FIG. 7) to selected batteries 81 and 82. By choice of twelve volt battery circuit 88 or twenty-four volt battery circuit 89, manually closing manual switch 86, pump 13 can thereby be respectively manually operated by manual switch 86, from operator panel 87, at a given standard speed or at approximately a double standard speed and, corresponding double capacity, for varied manual unlimited term of pump 13 activation by an operator of apparatus 10.

Power source 14 can be operated on automatic basis by activating trigger switch 86. Trigger switch 85 (FIGS. 1, 3, 4, 7 and 8) on carriage frame 11 is normally open (FIG. 7) and is adapted to be closed only by cam 95 pivoted at 96 on frame 11. Cam 95 has a switch actuating lobe 98 and a pin responsive lobe 99 and is normally retained, in a neutral position (FIGS. 1 and 8) by spring 100 anchored at 101 on carriage 11 and connected to eccentric portion of cam 95.

Main free wheeling wheel 24 is provided with pin 92 adapted to engage lobe 98 of cam 95 when wheel 24 is rotated as apparatus 10 is moved on surface 28.

When treating apparatus 10 is moved rearwardly (FIG. 3), wheel 24 will rotate counterclockwise forcing pin 92 to engage switch cam lobe 98 to rotate cam 95 clockwise against switch trigger 97. Trigger switch 85 will be momentarily closed (FIG. 7) as pin 92 engages and passes cam 95. After pin passes cam 95, cam will return to neutral (FIGS. 1 and 8) by spring 100 connected to eccentric portion of cam 95.

When main free wheeling wheel 24 is rotated clockwise as apparatus 10 is moved forwardly (rightwardly, FIG. 4) pin 92 of wheel will engage cam lobe 99 to momentarily rotate cam 95 counterclockwise. In this action, lobe 99 will not contact switch trigger 97 of switch 85 and switch 85 will not be closed. After pin passes cam 95, cam will return to neutral (FIGS. 1 and 8) by spring 100 connected to eccentric portion of cam 95.

If selector switch 84 is in automatic circuit mode position 94, current from selected batteries 81 and 82, passing through switches 88 or 89, will activate timer 102 which is adapted to being preset for a given time period. During the term of automatic activation of timer 102 activation, timer 102 will activate pump 13 for the time preset in timer 102. In this automatic mode, treating fluid 29 will only be dispensed when apparatus 10 is moved rearwardly, not when apparatus 10 is otherwise manipulated, as when turning, moving forward, or other repositioning.

As treating fluid 29 is caused to be pumped by pump 13, either by manual operation or by automatic operation as described herein, fluid 29 will be pumped through conduits 73 and 74, pump 13, conduit 76, inlet tube conduit 72 (FIGS. 1, 2, 6 and 7) and through release valve 77 (FIGS. 2, 5 and 6) into spray manifold tube 70 (FIGS. 5 and 6) and out spray apertures 71 (FIG. 6) onto floor surface 28 to be treated.

In operation, it may be desirable to create a puddle of treating fluid 29 on floor 28, to be treated so that treating fluid 29 can be forced into pad 46 and yarns 48 of the applicator assembly 12 to prime floor 28, pad 46, and yams 48 of assembly 12. To accomplish this priming, fluid treating supply tank 30 (FIGS. 1 and 8) is filled with treating fluid 29 and operator first closes main selector switch 83 (FIG. 7) and manual terminal 93 of switch 84 to create necessary manual circuitry.

Operator then selectively closes normally open manual switch 86 to activate pump 13 and retains switch 86 closed as long as operator desires fluid to be pumped onto floor 28. In this manual action, pump 13 will draw treating fluid from tank 30 through conduits 73, 74, pump 13, 76 and 72 into spray tube 70 and out tube openings 71 onto floor 28 to prime floor 28. Apparatus 10 can then be moved over floor 28 slightly to move pad 46 and yarns 48 into puddle treating fluid 29 on floor 28 to complete priming of pad 46 and yarns 48.

If applicator assembly 12 is against, or close to a wall or other vertical object, spray tube 70 might not release treating fluid 29 sufficiently forward to adequately prime floor 28 with treating fluid 29. In this instance, applicator assembly 12 can be raised (FIG. 8) to an upper position 57 or 58 by retracting handle 56. When handle 56 is raised, applicator pad 46 will pivot about pins 35 and spray tube 70 will tend to eject treating fluid 29 forwardly from apparatus 10 through release openings 71 to apply priming fluid 29 to floor 28 in front of apparatus 10 adjacent any such wall or other obstacle in front of apparatus 10. Applicator assembly 12 can thereafter be lowered by shaft handle 56 to apply applicator pad 46 to fluid 29 on floor 28 to prime pad 46 and yarns 48 with treating fluid 29.

Figure 7:
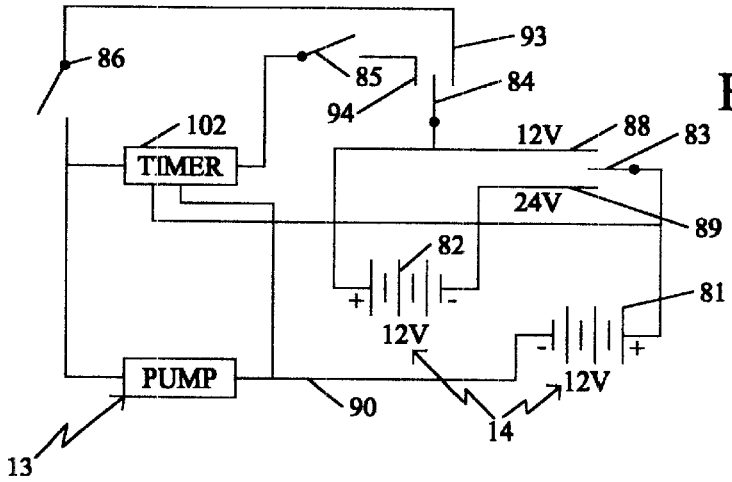
FIG. 7 is a schematic of the special electrical system of the invention.

After floor 28, pad 46 and yams 48 are primed with fluid 29 as may be desired by an operator and, as set forth above, selector switch 84 is moved to automatic trigger circuit contact 94 to activate automatic circuit 94 and deactivate manual circuit 93. At this time, no treating fluid 29 will be pumped until automatic trigger switch 85 is closed (FIG. 7). Trigger switch 85 will be closed when apparatus is moved rearwardly (left, FIGS. 1, 3 and 8) sufficiently to cause wheel to rotate counterclockwise and cause pin 92 to momentarily engage lobe 99 of cam 95. As pin engages lobe 99 of cam 95, cam 95 will be rotated clockwise, forcing cam lobe 98 into trigger arm 97 of automatic trigger switch 85, closing automatic switch 85 to activate timer 102.

Timer 102 will then activate power source 13 to in turn activate pump system 14, for a pre-selected time period, as apparatus 10 is moved rearwardly over floor 28, to pump fluid 29 onto floor 28 during the time interval set in timer 102. As apparatus 10 is continued to move over surface 28, this pump 13 timed actuation cycle will be repeated, as trigger switch 86 is actuated by pin 92 on wheel 24, to supply treating fluid to floor 28 to be spread by squeegee action of applicator assembly 12. It should be noted that pump system 13 will be cyclically activated for selected terms of activation independently of the rate of movement of apparatus 10 over floor 28 by an operator, giving the operator of apparatus 10 selective control over the application of treating fluid 29 between timing cycles, selectively independent of rotation of the wheels 24 of apparatus 10.

If neither timer 102 nor manual switching are not actuated, no fluid 29 will be expelled on floor 28 because of rotation of either of wheels 24. Apparatus 10 can thereby be rotated about itself, or otherwise manipulated over floor 28, without expelling fluid 29 or requiring a complicated fluid It is to be understood that the invention is not to be limited to the specific construction and arrangements shown and described, as it will be understood to those skilled in the art that certain changes may be made without departing from the principles of the invention.

What is claimed is:

1. A surface treating apparatus to be positioned and operated on the surface to be treated comprising, a carriage frame having opposite side portions between front and rear portions, one or more front wheels rotatably mounted on said frame adjacent said frame front portion for rotatably supporting said frame front portion for forward and rearward rolling frame movement on the surface to be treated, one or more caster wheels on said frame adjacent said frame rear portion supporting said frame rear portion on the surface to be treated for tracking and turning movement of said frame on the surface, a fluid treatment supply, surface fluid treatment applicator pivotally attached to said front portion of said frame and adapted to engage the floor, a manifold spray tube positioned transversely to said frame and said applicator and having downwardly opening release apertures to allow flow of treating fluid from said manifold over an area of the surface to be treated, a fluid treatment pressure supply pump for pumping fluid treatment supply under pressure, a power source connected to said fluid treatment pump for operating said fluid treatment pump, a pump conduit system means connecting said treating fluid supply with said manifold spray tube and said pump to facilitate flow of treating fluid from said fluid source through said pump system to supply treating fluid to the surface to be treated when said pump is actuated, normally off means in said power source to normally deactivate said power source, a pump triggering means responsive to cyclic rotation of one of said front wheels in one direction for actuating said normally deactivated means in said power source to actuate said pump, and timing means in said power source for selectively limiting the activation of said power source and said pump to a selected term of operation.

2. A surface treating apparatus as defined in claim 1 further comprising means for selectively moving said applicator away from said normally applied position.

3. A surface treating apparatus as defined in claim 2 wherein a normally closed fluid pressure responsive release valve is connected in said conduit means and adapted to open only when said pressure supply pump is activated to provide treating fluid under pressure in said conduit whereby treating fluid will only flow through the conduit when said pump is activated.

4. A surface treating apparatus as defined in claim 2 wherein said surface applicator comprises a plate having front and rear edge portions with opposing side edge portions extending there between, an absorbent pad secured to the bottom of said applicator plate for engagement with the surface to be treated and having front and rear portions respectively adjacent the front and rear portions of said plate, said surface applicator having said pivotal attachment to said frame between said rear edge portion of said plate and said front portion of said frame, and said pivotal attachment between said frame and said applicator being positioned on said frame a distance above the floor to be treated to normally position said applicator plate and said pad at a pivoted squeegee angle to the floor with said front portion of said pad resting on the surface of the floor and the rear portion of said pad spaced above the floor.

5. A surface treating apparatus as defined in claim 4 wherein said pad has fibrous yarn strands secured to and extend from said front and side edge portions of said pad for smoothing and spreading reaction with fluid treatment on the surface to be treated when said apparatus is moved rearwardly on said surface.

6. A surface treating apparatus as defined in claim 1 wherein said manifold spray tube is mounted in said surface applicator adjacent said rear portion of said applicator.

7. A surface treating apparatus as defined in claim 2 wherein said manifold spray tube is mounted in said surface applicator adjacent said rear portion of said applicator.

8. A surface treating apparatus as defined in claim 4 wherein said manifold spray tube is mounted in said surface applicator adjacent said rear portion of said applicator.

9. A surface treating apparatus as defined in claim 5 wherein said manifold spray tube is mounted in said surface applicator adjacent said rear portion of said applicator.

10. A surface treating apparatus as defined in claim 1 wherein said means responsive to cyclic rotation is actuated only when said apparatus is moved rearwardly.

11. A surface treating apparatus as defined in claim 2 wherein said means responsive to cyclic rotation is actuated only when said apparatus is moved rearwardly.

12. A surface treating apparatus as defined in claim 10 wherein said pump actuating means comprises a pin extending axially from one of said front wheels between the axis and perimeter of said wheel to rotate with said wheel, said trigger means is in the rotational path of said pin to be engaged by said pin and adapted to activate said power source when said apparatus is moved in the rearwardly direction.

13. A surface treating apparatus as defined in claim 1 wherein said power source is electricity and said pump is a corresponding electrically driven pump.

14. A surface treating apparatus as defined in claim 2 wherein said power source is electricity and said pump is a corresponding electrically driven pump.

15. A surface treating apparatus as defined in claim 13 wherein means is provided in said power source for varying the power of said power source to said pump to vary the output of said pump.

16. A surface treating apparatus as defined in claim 15 wherein said power source varying means comprises, a first electrical power source of a given power for driving said pump at a given fluid treatment capacity, a second electrical power source, of a given power, for driving said pump at a given fluid treatment capacity, and means for alternatively selecting either of said power sources or both of said power sources in series to respectively provide an alternately varied fluid treatment capacity for the treating apparatus.

17. A surface treating apparatus as defined in claim 12 wherein said power source varying means comprises, a first electrical power source of a given power for driving said pump at a given fluid treatment capacity, a second electrical power source, of a given power for driving said pump at a given fluid treatment capacity, and means for alternatively selecting either of said power sources or both of said power sources in series to respectively provide an alternately varied fluid treatment capacity for the treating apparatus.

18. A surface treating apparatus as defined in claim 3 wherein a normally closed pressure sensitive release valve is provided adjacent said manifold spray tube in said otherwise normally open fluid treatment supply connecting means for normally preventing flow of said fluid treatment to said manifold when said pump is not activated and being pressure adapted to open to allow fluid treatment fluid to flow into said manifold when said pump is actuated.

* * * * *